United States Patent [19]

Kinnunen et al.

[11] 3,946,286

[45] Mar. 23, 1976

[54] DEVICE FOR CONTROLLING THE FORMATION OF FROST ON COOLING RADIATORS AND THE DEFROSTING OF THE SAME

[75] Inventors: Paavo Kinnunen, Tahti; Viljo Lukkarinen, Kouvola, both of Finland

[73] Assignee: UPO Oskeyhtiő, Finland

[22] Filed: Oct. 30, 1974

[21] Appl. No.: 519,391

[30] Foreign Application Priority Data

Nov. 8, 1973 Finland ..... 3457/73

[52] U.S. Cl. ..... 317/124; 62/151; 250/222 R; 340/234

[51] Int. Cl.[2] ..... G01N 21/46

[58] Field of Search ..... 250/574, 221, 222; 62/140, 62/151; 340/234; 317/124

[56] References Cited

UNITED STATES PATENTS

| | | | |
|---|---|---|---|
| 3,120,108 | 2/1964 | Pansing | 62/140 |
| 3,188,828 | 6/1965 | Wayne | 62/140 |
| 3,423,596 | 1/1969 | French | 250/222 R |
| 3,647,301 | 3/1972 | Sturzinger | 250/222 R |

*Primary Examiner*—R. N. Envall, Jr.
*Attorney, Agent, or Firm*—Ladas, Parry, Von Gehr, Goldsmith & Deschamps

[57] ABSTRACT

A device to be used e.g. in cooling radiators, for monitoring the formation of frost and for defrosting. Frost formed on the cooling radiator causes a change in the quantity of light received by a light receiver from a light transmitter, and when the quantity of light received by said light receiver reaches a predetermined value a unit controlled by the light receiver initiates the defrosting which continues until all of the frost has molten.

8 Claims, 1 Drawing Figure

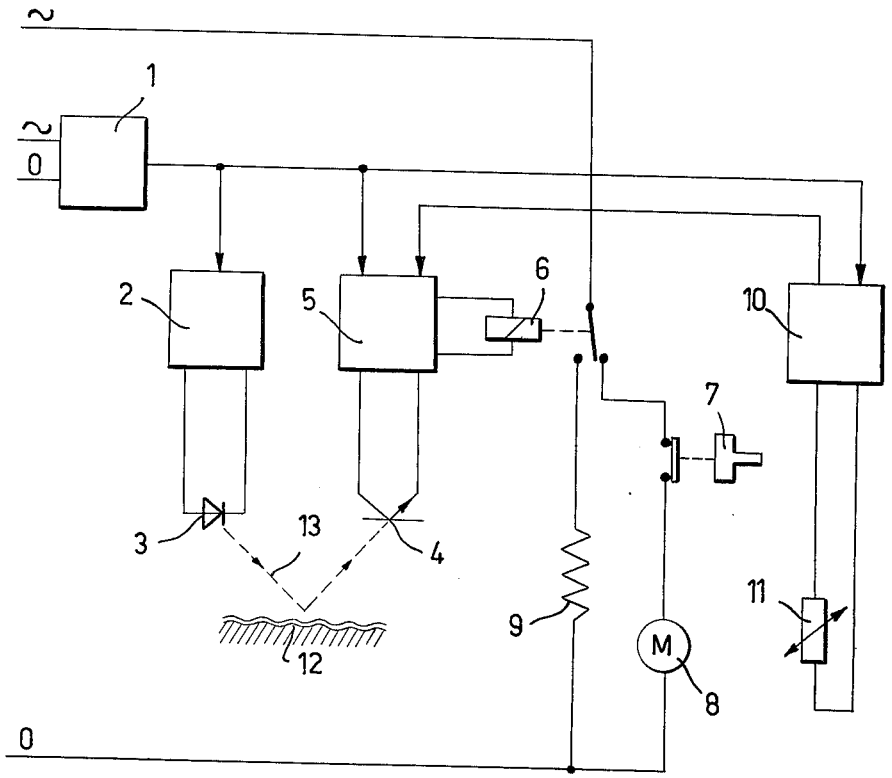
2
1
2
0
2
5
6
10
7
3
13
4
11
9
M
8
12
0

DEVICE FOR CONTROLLING THE FORMATION OF FROST ON COOLING RADIATORS AND THE DEFROSTING OF THE SAME

The present invention relates to a device for controlling the formation of frost on cooling radiators and the defrosting of the same, which device receives its operating voltage from a network component and in which a relay connects the power either to a cooling machinery or to a melting resistance.

The device in accordance with the invention automatically monitors the frost formed on cooling radiators, indicates the predetermined quantity of frost, carries out the defrosting and stops the defrosting after the frost has disappeared. The device can be used for controlling all cooling radiators in which frost is formed. The application to be discussed here is intended in particular for store equipment.

For carrying out the functions listed above, several different solutions have been used previously, all of which, however, have had considerable drawbacks.

Manual control requires continuous monitoring.

In defrosting controlled by a switching clock, the defrosting takes place as controlled exclusively by the clock irrespective of the quantity of frost.

Also, the beginning of the defrosting is independent of the quantity of frost if the defrosting is controlled by means of a clock and a thermostat.

Moreover, frost indication by means of thermistors and based on reduction in the air circulation in the cooling device has been used, whereby aging of the thermistors has, however, resulted in erroneous function, and, moreover precisely adjustable measuring circuits are required.

The devices based on the above solutions require a lot of maintenance and the mechanical components in them are worn.

The drawbacks described above can be avoided by means of the device in accordance with the invention. The device comprises:

- a light transmitter, the light of which is at least partly directed at the supposed place of frost formation,
- a light receiver,
- a memory unit which is controlled by said light receiver and which controls the switching of power to either said cooling machinery or said melting resistance, and
- means for stopping of the defrosting and connected to said memory unit.

Said light transmitter and said light receiver being arranged in such a way that frost formed on the cooling radiator causes a change in the quantity of light received by the light receiver from the light transmitter said change being transferred to the memory unit controlling the power which unit initiates the defrosting which goes on until said stopping means, having found that all the frost has melted restores the memory unit to the rest position.

By means of the device in accordance with the invention, the following advantages are obtained:

Defrosting takes place only after a predetermined quantity of frost has been formed, for which reason unnecessary defrostings are avoided.

The output of the cooling device is increased, because it never has to operate as excessively frosty (e.g. with the lamellas blocked) nor to eliminate any heat energy introduced in the cold space during an unnecessary defrosting. This is why the service life of the cooling device is increased and the requirement of maintenance is reduced.

The device in accordance with the invention can be designed as fully electronic, and under these circumstances it does not require continual maintenance and it has a long service life (no wearing parts).

Below, a preferred embodiment of the device in accordance with the present invention will be described more closely with reference to the attached drawings.

The device receives its operating voltage from a network component 1. Current pulses are fed through an oscillator 2 into a light-emitting diode (LED) 3 on the frost bulb. The light transmitter 3 transmits a light pulse 13, which is preferably within the infrared range in order to avoid disturbances caused by the ambient light. As the light transmitted by the light transmitter 3 in response to the current pulses received from the oscillator 2 is in the form of light pulses as distinguished from continuous or uninterrupted light, it follows that for a given intensity of light there will be less heat generated in the light transmitter 3 than in a continuous light transmitter and, consequently, less interference with normal frost formation at the place to which the light is directed.

If there is frost 12 at a near distance part of the light ray 13 is reflected back to a light-sensitive transistor (light receiver) 4 on the bulb. The light receiver controls a memory circuit 5, wherein a possible reflection caused by the frost remains stored. The memory circuit 5, on the other hand, controls a relay 6, which in its rest position connects power either to a cooling machinery 8 or to a melting resistance 9 after indication has taken place.

A thermostat 10, which is controlled by a sensing unit 11 (e.g., NTC resistance) at the cooling radiator, stops the defrosting by restoring the memory unit 5 to its rest state. The defrosting stops when all the frost 12 is molten, i.e. the temperature of the cooling radiator has increased to above 0°C. A thermostat controls the operation of the cooling device during periods of normal operation between the defrostings.

The invention is not restricted to the above embodiment only, wherein the operation of the device is based on reflection of light via frost 12 to the light receiver 4. Equally well the light transmitter 3 and the receiver 4 can be positioned so that the frost 12 constitutes an obstacle for the light ray, whereby a broken or weakened light ray is indicated.

What we claim is:

1. A device for controlling the formation of frost on cooling radiators and the defrosting of the same, which device receives its operating voltage from a network component and has a relay for connecting power either to a cooling machinery or to a melting resistance, comprising

- a solid state light transmitter the light of which is at least partly directed at the supposed place of frost formation,
- an oscillator connected to receive its operating voltage from said network component and to feed pulses of current to said light transmitter, whereby the light thereof is in the form of light pulses,
- a light receiver,
- a memory unit which is controlled by said light receiver and which controls the switching of power to either said cooling machinery or said melting resistance, and means for stopping of the defrosting and connected to said memory unit.

said light transmitter and said light receiver being arranged in such a way that frost formed on the cooling radiator causes a change in the quantity of light received by the light receiver from the light transmitter said change being transferred to the memory unit controlling the power which unit initiates the defrosting which goes on until said stopping means, having found that all the frost has melted, restores the memory unit to the rest position.

2. A device as claimed in claim 1, wherein the light transmitter and the light receiver are arranged so that the frost formed on the radiator reflects at least part of the light transmitted by the light transmitter to the light receiver.

3. A device as claimed in claim 1, wherein the light transmitter and the light receiver are arranged so that the frost formed on the radiator weakens the light coming from the light transmitter to the light receiver or completely prevents the light from arriving at the light receiver.

4. A device as claimed in claim 1, wherein the light transmitted by the light transmitter is infrared light.

5. A device as claimed in claim 1, wherein the light transmitter is a light-emitting diode.

6. A device as claimed in claim 1, wherein the light receiver is a light-sensitive transistor.

7. A device as claimed in claim 1, wherein the memory unit controls the power by means of a relay.

8. A device as claimed in claim 1, wherein the memory unit controls the power by means of semiconductor units, such as thyristors.

* * * * *